US006402802B1

(12) United States Patent
Bhagat

(10) Patent No.: US 6,402,802 B1
(45) Date of Patent: Jun. 11, 2002

(54) EXOFLASH CONSOLIDATION TECHNOLOGY TO PRODUCE FULLY DENSE NANOSTRUCTURED MATERIALS

(75) Inventor: Ram B. Bhagat, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 09/428,872

(22) Filed: Oct. 28, 1999

Related U.S. Application Data

(60) Provisional application No. 60/110,305, filed on Nov. 30, 1998.

(51) Int. Cl.[7] ..... C22C 29/02

(52) U.S. Cl. ..... 75/240; 419/14; 419/18; 419/23; 419/29; 419/38; 419/45; 419/48

(58) Field of Search ..... 75/236, 240, 245, 75/249; 919/14, 18, 23, 29, 38, 45, 48

(56) References Cited

U.S. PATENT DOCUMENTS

| | | | | | |
|---|---|---|---|---|---|
| 5,230,729 | A | * | 7/1993 | McCandlish et al. | |
| 5,320,800 | A | * | 6/1994 | Siegel et al. | 419/66 |
| 5,352,269 | A | * | 10/1994 | McCandlish et al. | |
| 5,561,829 | A | | 10/1996 | Sawtell et al. | 419/13 |
| 5,589,011 | A | | 12/1996 | Gonsalves | 148/334 |
| 5,651,808 | A | * | 7/1997 | McCandlish et al. | |
| 5,773,735 | A | * | 6/1998 | Dubensky et al. | |
| 5,792,403 | A | | 8/1998 | Massa et al. | 264/122 |
| 5,794,113 | A | * | 8/1998 | Munir et al. | 419/45 |
| 5,830,287 | A | | 11/1998 | Pinnow et al. | 148/334 |
| 5,855,997 | A | * | 1/1999 | Amateau | |
| 5,874,134 | A | * | 2/1999 | Rao et al. | |
| 5,984,996 | A | | 11/1999 | Gonsalves et al. | 75/246 |
| 6,001,193 | A | * | 12/1999 | Kojima et al. | 148/101 |
| 6,001,304 | A | | 12/1999 | Yoo et al. | 419/10 |

OTHER PUBLICATIONS

Arató, et al. "Sinter–Hip Treatment of Hard Metal from Nanocrystalline WC/Co Powder," Proc. 14$^{th}$ Intl. Plansee Seminar, 1997; vol. 2; pp. 658–664.*

Carroll, D. F. "Processing and Properties of Ultrafine WC/Co Hard Materials," Proc. 14$^{th}$ Intl. Plansee Seminar, 1997; vol. 2; pp. 168–182.*

Chepovetsky, et al. "Fracture Toughness of Multicomponent Hard Materials," Proc. 14$^{th}$ Intl. Plansee Seminar, 1997; vol. 2; pp. 391–402.*

Colin, et al. "Processing of Functional–Gradient WC–Co Cermets by Powder Metallurgy," Int. J. Refractory Metals & Hard Materials 12 (1993–1994), pp. 145–152.*

Gavish, et al. "Cemented Carbide Based on Submicron and Ultrafine Powders," Proc. 14$^{th}$ Intl. Plansee Seminar, 1997; vol. 2; pp. 703–717.*

Gell, Maurice. "Applying Nanostructured Materials to Future Gas Turbine Engines," JOM, Oct. 1994; pp. 30–34.*

Gille, et al. "A new 0.4 $\mu$m WC Powder as well as Powder–related Properties and Sintering Behaviour of 0.6 to 30 $\mu$m WC–Co hardmetals," Proc. 14$^{th}$ Intl. Plansee Seminar, 1997; vol. 2; pp. 139–167.*

Gilman, et al. "The Fabrication of Rapidly Solidified High Temperature Aluminum Alloys," *Advances in Powder Metallurgy,* MPIF, Princeton, NJ, 1991; pp. 47–57.*

Gleiter, H. "Materials with Ultrafine Microstructures: Retrospectives and Perspectives," *Nanostructured Materials,* vol. 1; 1992; pp. 1–19.*

Goren–Muginstein, et al. "Sintering Studies of Nanocrystalline WC Powder," Proc. 14$^{th}$ Intl. Plansee Seminar, 1997; vol. 2; pp. 622–633.*

Groza, et al. "Nanoparticulate Materials Densification," *Nanostructured Materials,* vol. 7, No. 7, pp. 749–768.*

Gleiter, H. "Nanostructured Materials—Scientific Background and Technological Perspectives," Mat. Sci. Forum vols. 189–190 (1995); pp. 67–80.*

Ha, et al. "Effect of WC size on the mechanical property of WC/Co alloy," P/M World Congress Proc., Washington D.C., 1996; Part 18; pp. 33–39.

Laptev, A.V. "Strength and Fracture Toughness of the WC–16%Co Fine Grained Cemented Carbides Obtained under High Pressure in Solid Phase," Proc. 14$^{th}$ Intl. Plansee Seminar, 1997; vol. 2; pp. 665–679.

Leitner, et al. "Shrinkage, Liquid Phase Formation and Gaseous Reactions During Sintering of WC–Co Hardmetals and Correlation to the WC Grain Size," Proc. 14$^{th}$ Intl. Plansee Seminar, 1997; vol. 2; pp. 86–99.

Matteazzi, Paolo. "Nanocomposite and Nanophase Materials Synthesized with Mechanical Energy," Mat. Tech. 1993; vol. 8; pp. 181–192.

McCandlish, L.E. "Chemical Processing of Nanostructured Materials," Mat. Tech. 1993; vol. 8; pp. 193–197.

McCandlish, et al. "The Inhibition of WC Grain Growth during Sintering of Nanostructured WC–Co Powder Compacts," Nanodyne Incorporated pamphlet, 1995; 4 pages.

(List continued on next page.)

*Primary Examiner*—Ngoclan Mai
(74) *Attorney, Agent, or Firm*—Konrad Raynes victor & Mann, LLP; Alan S. Raynes

(57) ABSTRACT

Embodiments include a method for fabricating a nanograined component from a nanograined powder composition. A compact is formed from the nanograined powder composition and sufficient heat is applied to the compact to generate at least one exothermic reaction while the compact is at a temperature lower than its eutectic temperature. Pressure is applied to the powder compact during the heating operation to consolidate the powder compact. The application of heat and pressure are controlled to inhibit grain growth and form a component having a nanograined microstructure that is at least 98 percent dense at a temperature lower than the eutectic temperature.

29 Claims, 8 Drawing Sheets

OTHER PUBLICATIONS

Mohan, et al. "Observation of Co Nanoparticle Dispersions in WC Nanograins in WC–Co Cermets Consolidated from Chemically Synthesized Powders," *Nanostructured Materials,* vol. 7, No. 5, 1996; pp. 547–555.

Persh, Jerome. "Research Opportunities for Materials with Ultrafine Microstructures," DOD/NASA/NMAB report, 1989; 6 pages.

Porat, et al. "Cemented Carbide from Micron Grain Size to Nano Size," Proc. 14$^{th}$ Intl. Plansee Seminar, 1997; vol. 2; pp. 183–196.

Porat, et al. "Sintering Behavior and Mechanical Properties of Nanocrystalline WC/Co," Mat. Sci. Forum, vols. 225–227 (1996); pp. 629–634.

Porat, et al. "Dilatometric Study of the Sintering Mechanism of Nanocrystalline Cemented Carbides," *Nanostructured Materials,* vol. 7, No. 4, 1996; pp. 429–436.

Sacks, et al. "Fracture Toughness of 'Nanocrystalline' WC–Co hard metals," Proc. 14$^{th}$ Intl. Plansee Seminar, 1997; vol. 2; pp. 680–688.

Seegopaul, et al. "Studies on Particle Size Effects and Compaction of Nanostructured WC–Co Composite Powders," P/M World Congress Proceedings, Washington D.C., 1996; Part 18; pp. 21–31.

Siegel, et al. "Mechanical Properties of Nanophase Materials," *Nanophase Materials: Synthesis–Properties–Applications,* ed. G. C. Hadjipanayis, et al; Dordrecht, The Netherlands, 1994; pp. 233–261.

Siegel, R. W. "Nanophase Materials: Synthesis, Structure, and Properties," *Physics of New Materials,* ed. By F. E. Fujita, Springer–Verlag, Heidelberg, DE; 1992; pp. 65–105.

Stiglich, et al. "Synthesis of Nano WC/Co for Tools and Dies," Tungsten and Refractory Metals 3, MPIF, Princeton, NJ, 1995; pp. 229–236.

Suryanarayana, et al. "The Structure and Mechanical Properties of Metallic Nanocrystals," Metallurgical Transactions A., vol. 23A, Apr. 1992; pp. 1071–1081.

Suryanarayana, et al. "Non–Equilibrium Processing of Powder Alloys for Aerospace Applications," *Advances in Powder Metallurgy,* MPIF, Princeton, NJ, 1991, vol. 6; pp. 15–29.

Wu et al. "Grain Growth Inhibition in Sintering of Nanostructured WC–Co Alloys," Proc. 13$^{th}$ Intl. Plansee Seminar, 1993; vol. 3; pp. 667–679.

PCT International Search Report for application PCT/US99/25714, mailing date Mar. 7, 2000.

PCT International Preliminary Examination Report PCT/US99/25714, mailing date Aug. 31, 2000.

Xueming et al., "Investigation of Nanostructured WC–Co Alloy Prepared by Mechanical Alloying," *Rare Metals,* vol. 17, No. 2, pp. 88–93 (Apr. 1998).

Xueming et al., "Structure and Properties of Bulk Nano–Structured WC–CO Alloy by Mechanical Alloying," *J. Alloys and Compounds,* No. 264, pp. 267–270 (1998).

Densley et al., "Fracture Toughness of a Nanoscale WC–Co Tool Steel," *Scripta Materialia,* vol. 38, No. 2, pp. 239–244 (1998).

Xueming et al., "Nanostructured WC–Co Alloy Prepared by Mechanical Alloying," *J. Alloys and Compounds,* No. 245, pp. L30–L32 (1996).

Groza et al., "Field Effects in WC–Co Sintering," *Advances in Powder Metallurgy and Particulate Materials, Proceedings of the 1997 International Conference on Powder Metallurgy and Particulate Materials,* Part 2 (of 3) Jun. 29–Jul. 2, 1997, Chicago, IL, vol. 2, pp. 12–51 to 12–60.

Jia et al., "Microstructure, Hardness and Toughness of Nanostructured and Conventional WC–Co Composites," *Nanostructured Materials,* vol. 10, No. 5, pp. 875–891 (1998).

* cited by examiner

EXOFLASH CONSOLIDATION TECHNOLOGY TO PRODUCE FULLY DENSE NANOSTRUCTURED MATERIALS

This application claims the benefit of U.S. Provisional Application No. 60/110,305, filed Nov. 30, 1998, entitled "Exoflash Consolidation Technology to Produce Fully Dense Nanostructured Materials," which is hereby incorporated by reference in its entirety.

FIELD OF INVENTION

Certain embodiments of the present invention relate to materials and processes for manufacturing components such as cutting tools.

BACKGROUND

The synthesis and processing of nanophase or nanostructured materials, i.e. materials with grain sizes less than about 100 nm, is currently of great interest because these materials are believed to have properties different from and often superior to the properties of conventional bulk materials. One application for nanostructured materials is in the cutting tool industry, where properties such as hardness and fracture toughness are important for producing wear resistant cutting tools. However, problems relating to both the synthesis of nanostructured powders and the consolidation of the nanostructured powders exist.

Nanostructured materials have been produced using synthesis methods such as electrodeposition, melt spun, spray conversion, high pressure sputtering, chemical vapor deposition and sol-gel processing. Cemented carbide powders having particles including nanosized grains have been formed using a spray conversion techniques such as those described in U.S. Pat. Nos. 5,230,729, 5,352,269 and 5,651,808. These patents describe for formation of powders in the tungsten carbide-cobalt system (WC—Co). WC—Co powders are often used for cutting tool applications. Controlled, high rate synthesis of nanometer sized powders having particles that are uniform in morphology and composition has been difficult to achieve. Powders tend to include particles on the order of micrometers in size, which are made up of agglomerates of nanosized grains.

Production of bulk nanostructured components having a high density and a nanostructured grain size has proven difficult due to the competing mechanisms of densification and grain growth. Consolidation of cemented carbide (WC—CO) powders into dense structures is typically carried out at elevated temperatures using liquid phase sintering, which utilizes temperatures above the eutectic temperature of the material. The high temperatures during liquid phase sintering, however, lead to undesirable grain growth. For example, a powder starting with 50 nm WC grains prior to liquid phase sintering may end up with WC grains larger than 1 $\mu$m after liquid phase sintering. Grain growth inhibitors such as VC and $Cr_3C_2$ may be added to the composition in an effort to control the grain growth during densification. The grain growth inhibitors, however, may deleteriously affect the physical properties of the material.

SUMMARY OF THE INVENTION

One embodiment of the present invention relates to a consolidated cemented carbide body having a mean carbide grain size of less than 100 nm. The body is consolidated to at least 98% of its theoretical density. The body has an average hardness in the range of 2000 to 2400 HV and an average fracture toughness of at least 16 MPa $m^{1/2}$.

Another embodiment relates to a consolidated nanostructured component including a microstructure with at least 25 percent of the grains being no greater than 100 nm in diameter and the component being at least 98 percent of its theoretical density.

Another embodiment relates to a method for fabricating a nanograined component from a nanograined powder composition, including forming a compact from the nanograined powder composition. Sufficient heat is applied to the compact to generate at least one exothermic reaction while the compact is at a temperature lower than its eutectic temperature. Pressure is applied to the powder compact during the heating operation to consolidate the powder compact. The application of heat and pressure are controlled to inhibit grain growth and form a component a nanograined microstructure that is at least 98 percent dense at a temperature lower than the eutectic temperature.

Yet another embodiment relates to a method for forming a body of at least 99.9% density, including providing a powder composition that exhibits an exothermic behavior in the solid state, the powder composition having a eutectic temperature. An amount of the powder composition is shaped into a body. Increasing amounts of heat and pressure are applied to the body to form a microstructure that is at least 99.9% dense, and the application of heat and pressure to the body is stopped at a temperature above the exotherm temperature and below the eutectic temperature of the composition.

Still another embodiment relates to a method for consolidating a nanograined powder including providing an electrically conductive nanograined powder mass. A high voltage electric current is applied to the powder mass and pressure is applied to the powder mass to consolidate the mass.

BRIEF DESCRIPTION OF THE DRAWING

Certain embodiments of the invention are described with reference to the accompanying figures which, for illustrative purposes, are not necessarily drawn to scale.

DETAILED DESCRIPTION

Certain embodiments of the present invention relate to the consolidation of nanograined powders into fully dense, nanograined bulk shapes. This may be accomplished by optimizing the process parameters including temperature, pressure, and the time in order to achieve full densification while controlling grain growth to a minimum.

The present inventors have found that according to certain embodiments, rapid application of pressure in conjunction with exothermal activity, below the eutectic temperature can be used to consolidate nanograined powder into nanograined bulk structures having superior physical properties. Nanograined powders have been observed to exhibit one or more exotherms as they are heated in the solid state. An exotherm represents a temperature which triggers an exothermic reaction accompanied with a sudden release of energy from a material upon heating due to a change in atomic configuration, change in crystal structure, or a chemical reaction taking place. It has been observed by the present inventors that upon heating in the solid state, a nanograined material will undergo at least one exotherm in the solid state. It is believed that this exotherm is associated with changes in atomic configuration of the nanograins from a less ordered state to a more ordered state. The mobility of these nanograins may reach a maximum at the exotherm temperature. By applying pressure at the exotherm temperature, bodies having 100% or near 100% density can be formed at temperatures below those used for conventional processing techniques utilizing liquid phase sintering to consolidate the body.

Figure 1:
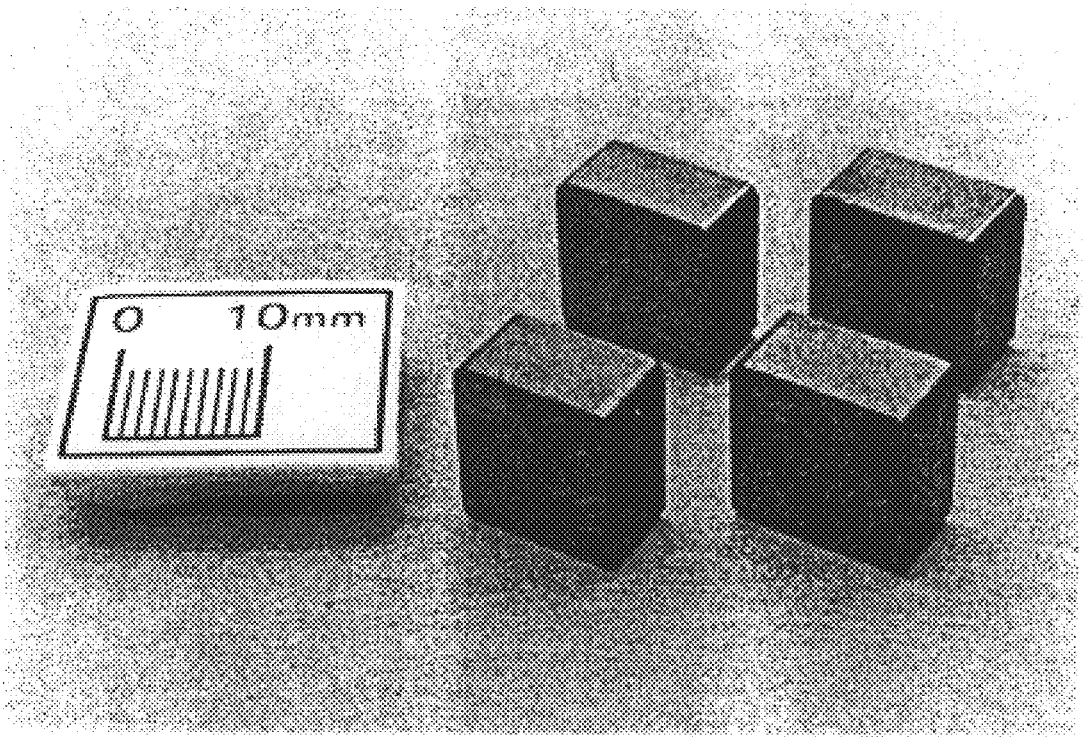
FIG. 1 is a perspective view of a cutting tool insert according to an embodiment of the present invention.

Certain preferred embodiments of the present invention relate to processing methods and structures formed using cemented carbide powders having a nanograined structure. Test samples were made using a commercial nanocrystalline cemented carbide powder (WC-10 wt % Co) obtained from Nanodyne Inc., of Brunswick, N.J. An elemental analysis of the as received powder indicated a composition including about 84.5 wt % W, 9.8 wt % Co, and 5.6 wt % C. The powder included agglomerated particles having an average particle size of about 34 $\mu$m. The agglomerated particles included WC grains on the nanograin scale in a Co matrix. Test samples were fabricated from the WC—Co powder as follows. A hot press (model #2330-2, from GCA Corporation/Vacuum Industries, Somerville, Mass.) was used to consolidate the nanostructured cemented carbide powder into bulk shapes for fabricating cutting tools. The press can achieve a maximum force of 100 tons. The heating elements in the hot press are graphite and can achieve a maximum temperature of 2500° C. A controller (GCA Corporation Vacuum Industries Controller with integrated modules including Setpoint Programmer Model UP55-0, temperature readout Model 560, and pressure readout model name Analogic Ram Force) is used for controlling the application of temperature and pressure in the hot press. Two types of dies were fabricated for consolidating the cemented carbide powder. The first was a cylindrical die used to fabricate pellets of 1 inch diameter and 0.5 inch thickness. The pellets are used to fabricate square cutting tool inserts such as the inserts illustrated in FIG. 1. The second was a rectangular die used to fabricate bars of 4 by 0.5 by 0.5 inches. The rods are used to fabricate ball end mills.

The interior of the die surfaces were coated with boron nitride (commercially available) to prevent sticking of the nanostructured cemented carbide powder to graphite. The boron nitride coating is sprayed onto the die and dries in air within a few minutes. The nanostructured powder was poured into the die over a bottom punch of graphite. No grain growth inhibitors were added to the powder. In addition, no polymer binder material was added to the powder mixture. A plastic brush was used to level the powder inside of the die. A graphite top punch was inserted into the die. The assembled die was put inside of the pressing chamber of the hot press. A thermocouple is positioned near the die for measuring temperature. The heating rate and pressing rate are programmed in advance into the controller. The chamber door is closed and the chamber evacuated. Once vacuum conditions are obtained, heating and pressure cycles are activated. The vacuum conditions are preferred due to the die (and heating elements) being fabricated from graphite. Other embodiments do not require the use of vacuum conditions. After the intended temperature is achieved, the consolidation is considered complete and the pressure released and power to the heating element turned off. Once the die cools to near room temperature, the chamber is opened and the die removed. The top and bottom punches are carefully removed to extract the consolidated body. The consolidated body may then be finished using a technique such as EDM (electro-discharge machining).

In a preferred processing technique, the temperature was programmed to rise about 20° C. per minute to reach 1300° C. Pressure was programmed to reach 8000 psi to coincide with the temperature of 1300° C. The initial pressure was set to about 800 psi and the pressure set to increase at about 112.5 pounds per minute, so that at 1300° C. the pressure reaches about 8000 psi. It was determined that the test material exhibited exotherms at about 400–550° C. and at about 850–1250° C. The exotherm temperature may be influenced by a variety of factors, including the particle size and composition, the atomsphere, the presence of impurities, and the amount of mixing the powder has undergone. At the exotherms, it is believed that the specimen rapidly consolidates under the applied pressure preventing formation of skeleton-type structure. The rapid consolidation likely occurs due to the rearrangement of the atomic structure of the nanometer size grains. The formation of a skeletal structure during processing is prevented by the continuous application of the pressure. If a skeletal structure were to form, it would be difficult to achieve full densification of the body without increasing the temperature above that of the eutectic temperature in order to promote liquid phase sintering.

By applying sufficient pressure at the exotherm temperature, full densification may be obtained at temperatures below the eutectic temperature and a truly nanograined body is formed. The continuous application of pressure and temperature further ensures removal of porosity with minimal or no grain growth.

The grain size of fully dense cemented carbide cutting tool inserts fabricated as described above was measured from high magnification scanning electron microscopy (SEM) pictures of etched samples of the consolidated inserts. The density of the material was found to be about 14.50 g/cm$^3$, which is 100% of the theoretical density for the cemented carbide composition.

Specimens fabricated according to embodiments of the present invention were compared with commercial specimens of WC—Co having approximately 10 wt % Co. Samples were metallographically polished and etched. WC grains in the commercial materials were clearly distinct with sharp edges in the background binder phase (a solid solution of WC and Co) under optical microscopy examination (magnification ranging from 500× to 1000×). However, the WC grains in the filly dense nanograined materials could be seen clearly only by a scanning electron microscopy (SEM) at magnifications exceeding 10000×. Even at these high magnifications, the WC grains appeared to be clustered and individual grains were sometimes not resolved even at 14000×. Further increase in magnification on the SEM was not useful because of poor clarity.

Figure 2:
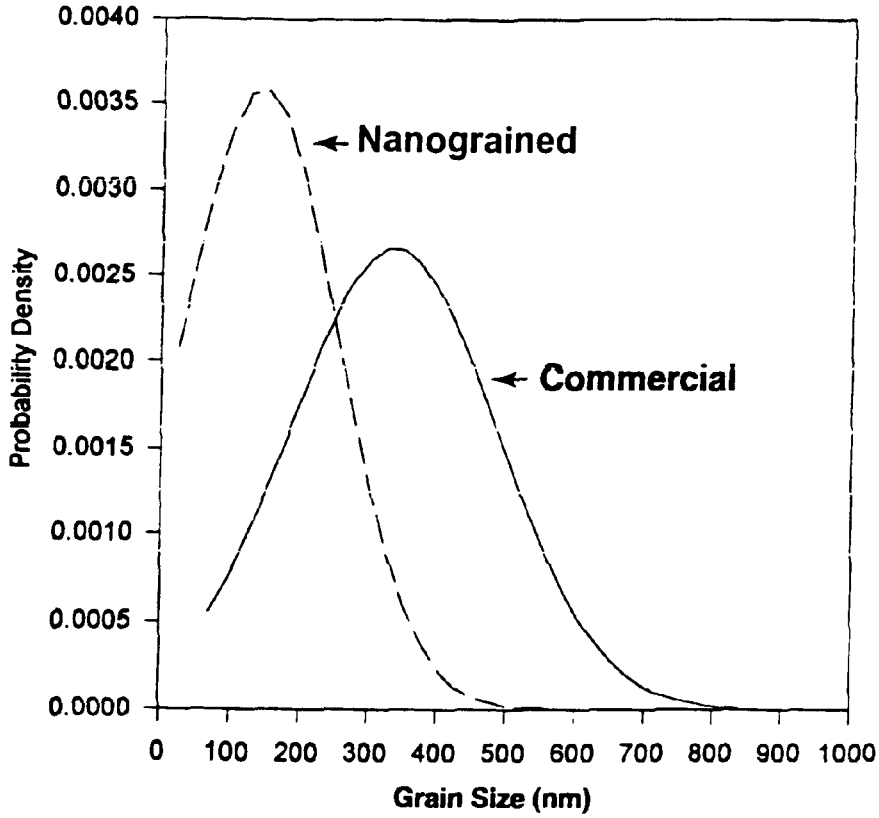
FIG. 2 is a plot of grain size comparison between a nanograined specimen according to an embodiment of the present invention and a commercial cemented carbide specimen.

High magnification pictures were taken from different regions of the specimens. These pictures were used to determine the WC grain size following standard procedures. The data were analyzed for statistical descriptions. The statistical smooth plots (see FIG. 2) represent the general trend of the grain size variation in a filly dense nanograined specimen versus a fine grained commercial cemented carbide specimen. The peaks do not necessarily represent the average grain size; for an ideal normal distribution of grain size wherein the average grain size will be the same as median ($d_{50}$) grain size, the peak will represent the average grain size. For skewed distribution to the right (or higher size), the peak will coincide with a value higher than the actual average size. The actual average grain size of the fully dense nanograined material was about 85 nm versus about 340 nm for the commercial material that is included in FIG. 2. In general, if about 25% or more of the grains are determined to be about 100 nm or less in diameter, then the grain size may be considered to be nanograined or nanostructured. Other commercial cemented carbides having about 10 wt % Co have been determined to have an average WC grain size exceeding 500 nm and less than about 1% of the grains below 100 nm in diameter.

Transmission electron microscopy (TEM) analysis revealed that at least some of the WC grains viewed as individual grains in the SEM pictures were made up of clusters of smaller grains for the fabricated specimens of embodiments of the present invention. The nature of the TEM samples prevented a statistical analysis of the grain size from being performed.

Figure 3:
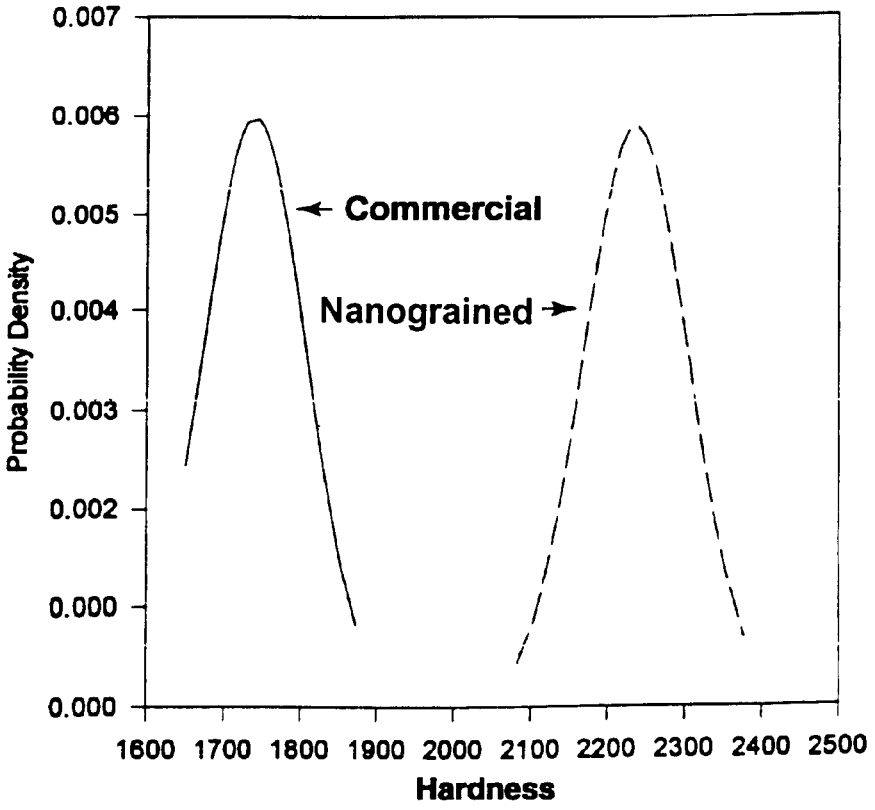
FIG. 3 is a plot of hardness comparison between a nanograined specimen according to an embodiment of the present invention and a commercial cemented carbide specimen.
Figure 4:
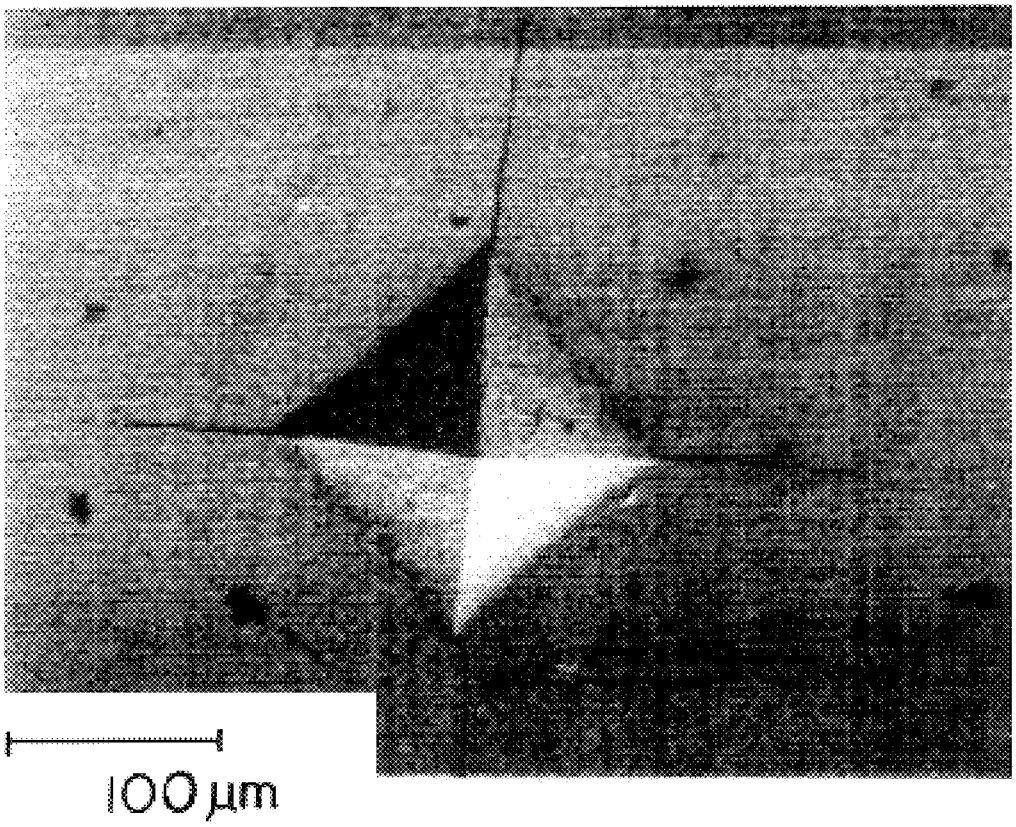
FIG. 4 is a perspective view of an indentation and cracks extending from the indentation in a specimen formed according to an embodiment of the present invention.
Figure 5:
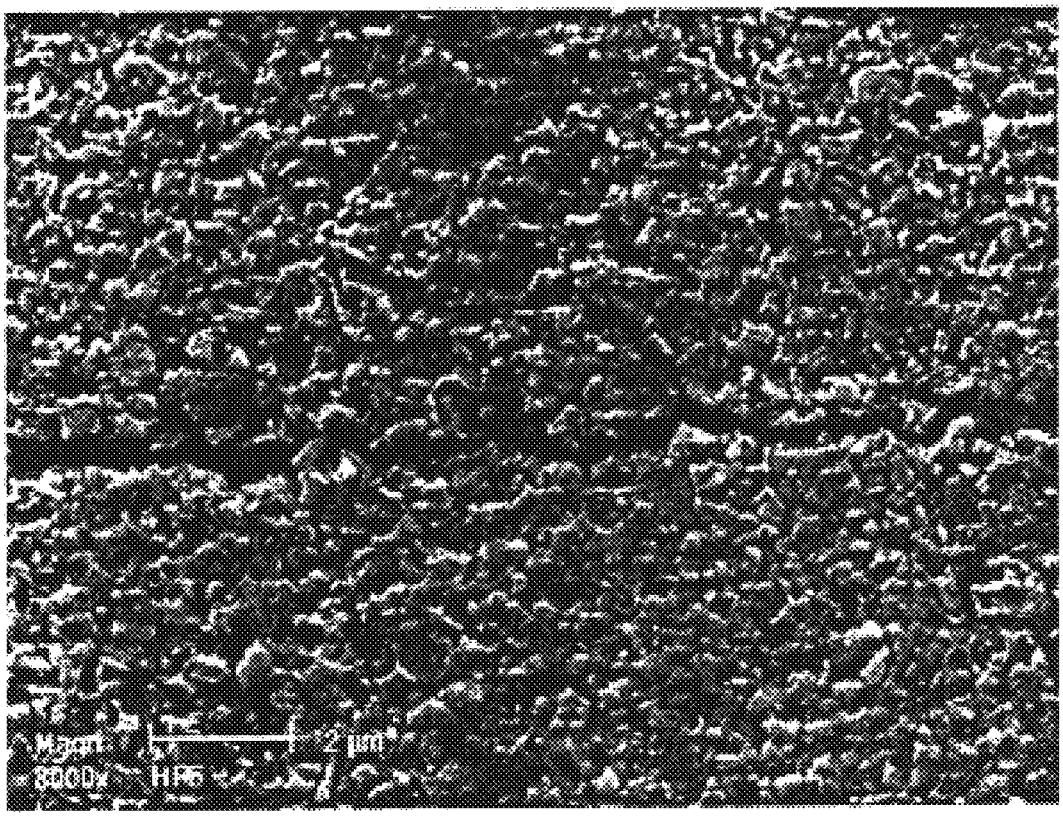
FIG. 5 is a perspective view of the crack propagation through a specimen formed according to an embodiment of the present invention.

The microhardness was determined using the Vicker's indentation method using a load of 500 grams. The data in FIG. 3 shows that the fabricated nanograined specimens exhibit a considerably higher hardness range than the commercial WC—Co tool material. The hardness of the fabricated specimens ranged from about 2100 to about 2390 HV, whereas the commercial specimens ranged from about 1650 to about 1880 HV. The upper range of the fabricated specimens, 2390 HV, approaches that of pure WC (2400 HV). Fracture toughness was determined by the indentation crack length method using loads of 10, 20 and 30 kg. An example of an indentation and cracks extending from the indentation in a fabricated nanograined specimen is shown in FIG. 4. In the fabricated specimens, the crack growth propagated along a tortuous path as illustrated in FIG. 5, which shows the crack path in an etched surface magnified at 8000×. The average fracture toughness for the fabricated specimens was in the range of about 16 to about 18 MPa $m^{1/2}$, versus about 6 to about 10 MPa $m^{1/2}$ for the commercial specimens.

Figure 6:
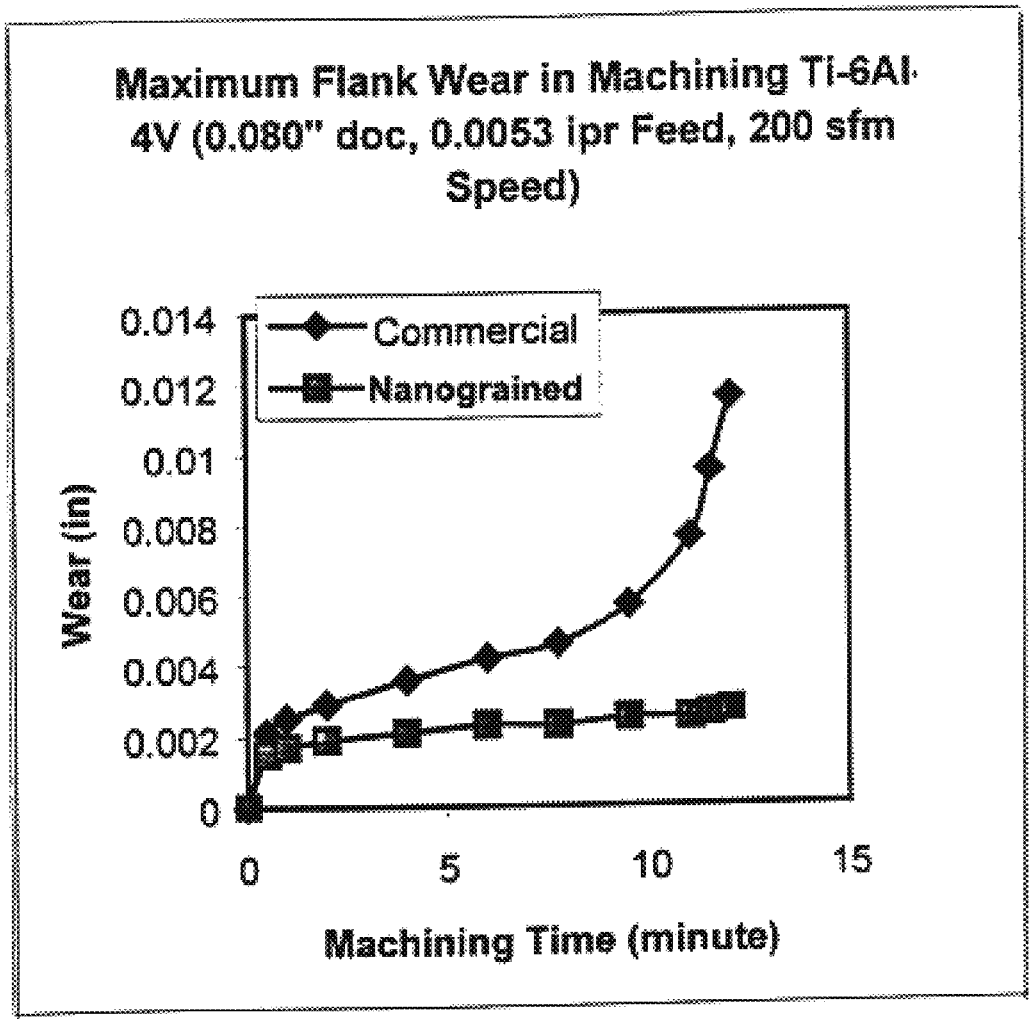
FIG. 6 is a plot of wear versus machining time between a nanograined specimen according to an embodiment of the present invention and a commercial cemented carbide specimen.

Machining tests were also conducted to compare the cutting performance of the fabricated nanograined specimens versus the commercial specimens. As shown in the data of FIG. 6, the nanograined cemented carbide material showed significantly less wear than the commercial material. The test measured maximum flank wear in machining a titanium-aluminum-vanadium alloy (Ti-6Al-4V) at 0.080 inches doc (depth of cut), 0.0053 ipr (inches per revolution) feed, and 200 sfm (surface feet per minute) speed. The results indicated that after about 5 minutes of machining time, the nanograined cemented carbide material showed about one half as much wear as the commercial material, and after about 10 minutes of machining time, the nanograined cemented carbide material showed about one third as much wear as the commercial material. As the machining time increased beyond 10 minutes to about 12.5 minutes, the level of wear of the nanograined cemented carbide material remained relatively constant, whereas the commercial material showed a steep increase in wear.

Embodiments may include a variety of temperature and pressure schemes depending on factors such as the composition of the powder and the processing equipment being used. A hot press such as that described above is a passive heating system. For such a system a wide range of temperatures and pressures may be used. Preferably the rate of temperature increase is in the range of about 1° C. per minute to about 100° C. per minute, even more preferably about 10° C. per minute to about 40° C. per minute. As noted above, a specific preferred heating rate is about 20° C. per minute. If the heating rate is too slow, than the process will take a long time. Longer processing times can also lead to undesirable grain growth. If the heating rate is too fast, there is risk of the outer regions of the specimen being at a substantially higher temperature than the interior of the specimen thereby preventing uniform densification. This can even lead to thermal stresses which may crack the specimen. If an active heating process, such as, for example, inductive heating, microwave heating, explosive forming, or resistive heating of the specimen is used, then the temperature may be quickly increased throughout the sample in a uniform manner. For such processes, the heating rate may be significantly faster than 100° C. per minute, and the entire heating process, for example, room temperature to 1300° C., may be accomplished in minutes or even seconds.

In certain embodiments, the time spent at the maximum temperature (below the eutectic temperature) may vary, depending on how close the temperature is to the eutectic temperature. For example, in the WC—Co nanograined specimens fabricated as described in the example above, the heat was turned off when the maximum temperature of 1300° C. was achieved, so the specimens remained at the maximum temperature for a time in the range of about one second to about one minute. For the WC—Co case, the eutectic temperature is about 1320° C. A temperature of 1300° C. is close to the eutectic temperature, so the time needed was relatively short. If the maximum temperature applied to the specimens were lower, it may be desirable to hold the specimens at the temperature for a longer time of up to, for example, one hour.

It is also preferable apply increasing pressure in conjunction with the increase in temperature. In the WC—Co example above, the pressure was set at a low initial value (so that the pressure would begin to register on the machine as it increased) of about 800 psi. This value may vary depending on the sensitivity of the pressure measuring mechanism and the powder materials/characteristics. The temperature may be set to linearly increase, and the pressure may likewise be programmed to increase linearly with the rise in temperature. A preferred pressure range is from about 5000 psi to about 12000 psi. A preferred final pressure for the WC—Co specimens discussed above was about 8000 psi at 1300° C. The total time of heating and pressure application for the WC—Co specimens was just above one hour. The heat and pressure were then removed and the specimen allowed to cool in the die. Other heating and cooling schemes may also be utilized if desired.

It is believed that any material that will show an exothermic behavior during heating in the solid state may be consolidated according to embodiments of the present invention. The exotherm temperature of a powder may be determined by a variety of known methods, including, for example, differential scanning calorimetry (DSC) and differential thermal analysis (DTA).

A variety of materials other than cemented carbides may show exothermic behavior during heating in the solid state and can be processed in a manner similar to that described above for WC—Co. Examples of such materials include, but are not limited to other cemented carbides, metals, alloys, ceramics and intermetallics. Other cermet compositions including TaC, TiC, $Cr_2C_3$, TiN and HfC hard phases may be processed in a manner similar to that described above. In certain embodiments, the materials that show exothermic behavior upon heating in the solid state are not nanostructured. For example, mixtures of certain metal powders of various grain sizes, including those larger than 100 nm, will react exothermally at certain temperatures to form intermetallic compounds when heated in the solid state. This type of exothermic reaction occurs when a metal such as aluminum reacts with another metal (such as, for example, titanium or nickel) to form an aluminide intermetallic. For example, aluminum and titanium will react in the solid state to form titanium aluminides such as, for example, $Ti_3Al$, TiAl and $TiAl_3$. Likewise, aluminum and nickel will react in the solid state to form nickel aluminides such as $Ni_3Al$, NiAl, and $NiAl_3$. Embodiments may also be used for the consolidation of micron-sized amorphous particles to result in nanoscale grains and precipitates. Such embodiments include various amorphous aluminum alloy powders such as AlFe—Ce, Al—Ce—Cr—Co, Al—Y—Ni—Co, Al—Fe—Ce—W, and Al—Fe—V—Si. Components which may be fabricated from such powders include, but are not limited to gas turbine components, automobile turbo and/or superchargers, or other high temperature components. In addition to the formation of bulk structures such as tools of various sizes (for example, cutting tools, grinding tools, microdrills, etc.), a variety of coatings including fiber coatings, sheet coatings, and even multilayer coatings may be formed according to embodiments of the present invention.

An example of a processing method for forming a nanograined coating on a wire or plate is as follows. First, a coating of nanograined material is sprayed onto the wire or plate using a spray technique. Next, for the plate a hot roller can be rolled on to the sprayed powder, maintaining a certain pressure at the contact line, such that the roller temperature coincides with the exotherm temperature of the sprayed powder. The result will be a coating of good quality without adversely affecting the properties of the substrate plate. For the wire, it can be pulled through a conical hole in a heated metallic die such that the temperature seen by the wire coincides with the exotherm temperature for the powder material.

Of course, a variety of processing methods may be utilized to apply heat and pressure so that consolidation in conjunction with solid state exothermic behavior takes place. For example, in addition to hot pressing, other methods including, but not limited to forging, hot isostatic pressing, rolling, extruding, and superplastic fabrication may be used for applying any combination of heat and pressure to consolidate materials displaying exothermal behavior in the solid state to form various components. Embodiments may also be applied to join materials together to form, for example, functionally graded materials.

In another aspect of embodiments of the present invention, it was observed during TEM examination of the WC—Co nanostructured cemented carbide powder that the powder exhibited quasi-fluid behavior when irradiated with electrons at a high voltage (up to 120 KV). When subjected to a high voltage electric field, the atomic configurations at the surface of WC nanocrystals and that of amorphous to nanocrystalline cobalt binder (as evidenced by TEM analysis) appear to be disturbed to a high energy level associated with a quasi-fluid state which is different than melting. Melting is a phase transformation from solid state of matter to a liquid state. The quasi-fluid state is a solid-state phenomenon wherein at least some of the atoms are loosely bound and hence acquire the flow characteristics of a fluid or liquid.

Embodiments may also include the application of a pressure in the quasi-fluid state of an electrically conductive nanocrystalline powder. Such a process will lead to densification without significant grain growth. The quasi-fluid state can be achieved by applying a high voltage electric current, which will also provide heating of the powder. Secondary heating or pressing may optionally be used. In one example of such a process, a powder mass (nanocrystalline or amorphous but electrically conductive) can be put in a non-metallic die with metallic bottom and top punches. Electric current can be passed through the powder mass by providing a high voltage across the bottom and top punches. Arrangement can be made to apply a pressure using, for example a press or a forging apparatus coinciding with the passage of current through the powder mass. The compacted mass should have full densification almost instantaneously with little or no grain growth. A secondary step such as hot isostatic pressing, forging or extrusion may be utilized if necessary to obtain a desired nanostructure, compositional homogeneity, and/or elimination of any remnant pores in the consolidated material.

Materials formed according to certain embodiments of the present invention will display 100% or near 100% density and an average grain size or about 25% of the grains less than about 100 nm.

Figure 7:
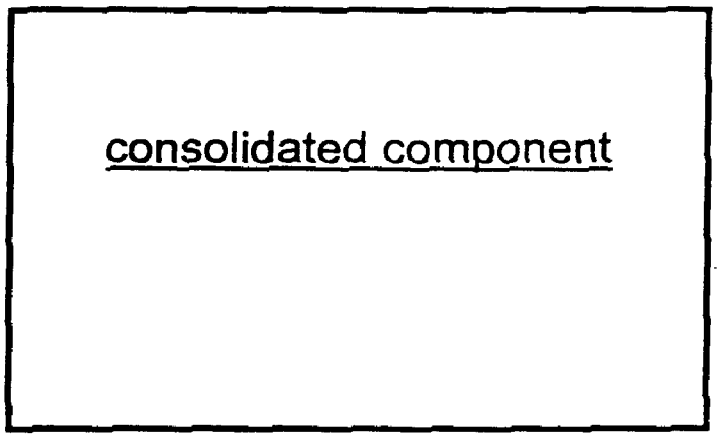
FIG. 7 is a schematic view of a consolidated component according to an embodiment of the present invention.
Figure 8:
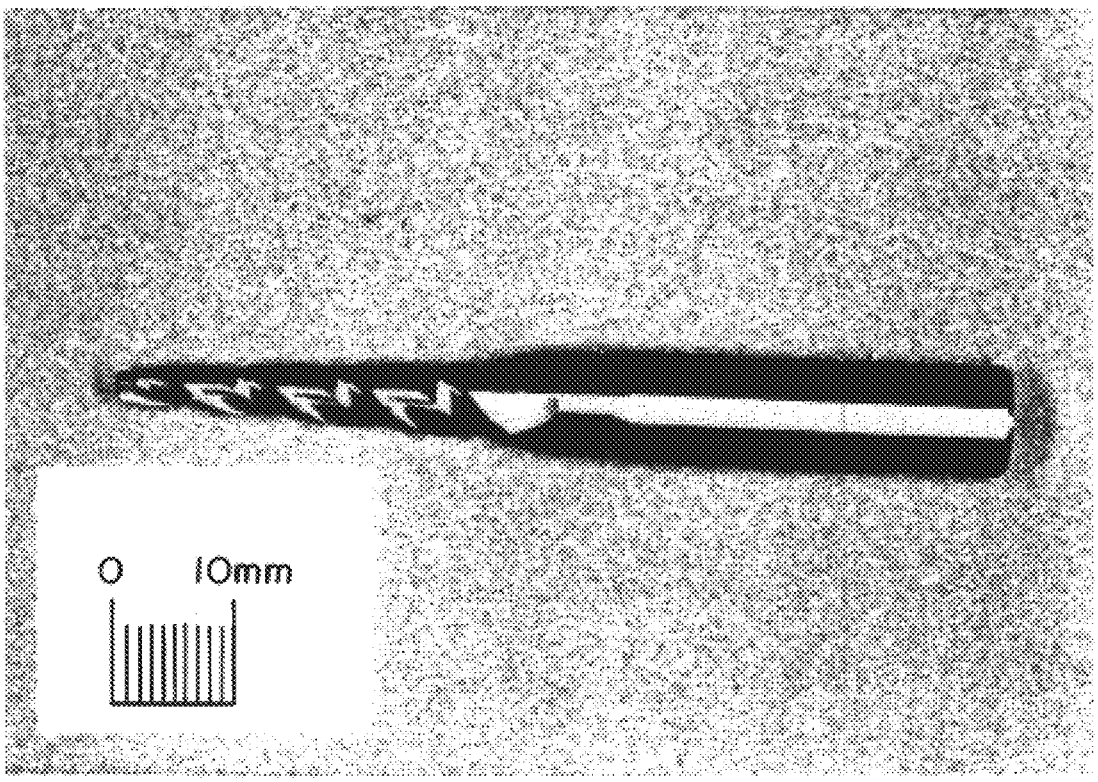
FIG. 8 is a perspective view of a milling cutter according to an embodiment of the present invention.

When compared with conventional materials of similar composition, materials according to embodiments of the present invention will display improved hardness, fracture toughness, wear resistance, thermal and electrical conductivity, superplasticity, ballistic performance, and magnetic properties. Such improved properties can be utilized to form consolidated components (FIG. 7) in a variety of applications including, but not limited to machining components (both macromachining and micromachining), dies and preforms for materials processing, engine components, ordnance components, and other heat resistant and/or wear resistant components. Examples of such components include the tool inserts illustrated in FIG. 1 and the milling cutter illustrated in FIG. 8.

In addition, embodiments of the present invention include processes for forming improved materials that are fast and efficient. For example, certain preferred embodiments do not require a polymer binder or any grain growth inhibitors. As a result, the mixing steps that would otherwise be carried out to ensure a homogeneous mixture with these ingredients are not needed. In addition, no binder burnoff step is required. Furthermore, preferred embodiments do not include periods in which the temperature and/or the pressure is held constant for an extended period of several hours, as in conventional compaction and sintering methods. Instead, it is preferred that the temperature and pressure are continuously increased to a temperature below the eutectic temperature of the material, and then the heating is stopped and pressure is removed from the specimen.

While certain preferred embodiments relate to consolidated components having full density or at least 99.9% theoretical density, other embodiments may be fabricated to have with lower densities, such as, for example, 98% or 99% of the theoretical density, depending on the application for the component.

In addition, while not required for certain preferred embodiments of the present invention, additive materials such as grain growth inhibitors (for example, vanadium carbide and chromium carbide) may be present in certain powder formulations. These additives may in certain embodiments tend to be segregated and thus not evenly distributed throughout the specimen. After densification is completed in the solid state using a method such as that described above, it may in certain embodiments be desirable to anneal the specimen with or without externally applied pressure at a temperature just at or above the eutectic temperature for a short time in order to increase the uniformity of the distribution of the additive material throughout the specimen. The time for such an annealing treatment may range form less than one 1 minute to about 60 minutes. For example, for a temperature just above (up to about 20° C.) the eutectic temperature, a longer time (for example, up to about 60 minutes) may be necessary to achieve homogeneity. For a temperature higher than about 20° C. above the eutectic temperature, (for example, up to about 50–80° C. above the eutectic temperature), a time of less than one minute may be sufficient to achieve homogenization. It may also be desirable to keep the pressure applied while performing the annealing step.

While the invention described above presents some of the preferred embodiments, it is to be understood that the invention is not limited to the disclosed embodiment but rather covers various modifications and equivalent arrangements included within the spirit and scope of the appended claims.

What is claimed is:

1. A consolidated cemented carbide body comprising:

a mean carbide grain size of less than 100 nm;

the body being at least 98% of its theoretical density;

the body having an average hardness in the range of 2000 to 2400 HV; and the body having an average fracture toughness of at least 16 MPa $m^{1/2}$.

2. A structure as in claim 1, wherein the body is at least 99.9% of its theoretical density.

3. A structure as in claim 1, wherein the body comprises tungsten carbide and cobalt.

4. A structure as in claim 1, wherein the body consists of tungsten carbide and cobalt.

5. A structure as in claim 1, wherein the body comprises a machining tool.

6. A structure as in claim 1, wherein the carbide grains comprise at least one material selected from the group of TaC, TiC, $Cr_2C_3$, and HfC.

7. A structure as in claim 3, wherein the body is at least 99.9% of its theoretical density.

8. A structure as in claim 1, wherein the cemented carbide body includes carbide phase and a transition metal phase, the transition metal comprising at least one metal selected from the group consisting of iron, nickel, and cobalt.

9. A structure as in claim 2, wherein the cemented carbide body consists essentially of about 84 to about 85 wt % W, about 9 to about 10 wt % Co, and about 5 to about 6 wt % C.

10. A structure as in claim 2, wherein the cemented carbide body comprises WC present in a range of about 75 to about 95 wt % and Co present in a range of about 5 to about 25 wt %.

11. A method for fabricating a nanograined component from a nanograined powder composition, comprising:

forming a compact from the nanograined powder composition;

applying heat to the compact sufficient to generate at least one exothermic reaction while the compact is at a temperature lower than its eutectic temperature;

applying pressure to the powder compact during the heating operation to consolidate the powder compact;

controlling the application of heat and pressure to inhibit grain growth and form a component having a nanograined microstructure that is at least 98 percent dense at a temperature lower than the eutectic temperature.

12. A method as in claim 11, wherein the heating is carried out by programming a controller to apply heat in a continuously increasing manner to a predetermined maximum temperature that is below the eutectic temperature of the powder composition and then turn off the heat after the maximum temperature is reached.

13. A method as in claim 12, wherein the heat is turned off within 1 minute after the maximum temperature is reached.

14. A method as in claim 12, wherein the application of heat and pressure is controlled to form a component having a nanograined microstructure that is at least 99 percent dense.

15. A method as in claim 12, wherein the application of heat and pressure is controlled to form a component having a nanograined microstructure that is at least 99.9 percent dense.

16. A method as in claim 12, wherein the nanograined powder compact is heated to a temperature sufficient to exhibit a first exothermic reaction at a first temperature and a second exothermic reaction at a second temperature, wherein both exothermic events occur at temperatures lower than the eutectic temperature of the powder composition, and pressure is applied in an increasing manner so that more pressure is applied to the compact at the second exotherm temperature than at the first exotherm temperature.

17. A method as in claim 16, wherein the nanograined powder composition comprises tungsten carbide and cobalt and the nanograined powder is heated to a maximum temperature of about 1300° C.

18. A method as in claim 12, wherein the powder compact is consolidated to a density of at least 98% of its theoretical density at a temperature below its eutectic temperature.

19. A method as in claim 11, wherein the powder compact is consolidated to a density of at least 99.9% of its theoretical density at a temperature below its eutectic temperature.

20. A method as in claim 11, wherein the heat is applied in a continuously increasing manner from room temperature to about 1300° C.

21. A method as in claim 12, wherein the pressure is applied to reach a maximum in the range of about 5000 psi to about 12000 psi when the temperature reaches about 1300° C.

22. A method as in claim 21, wherein the maximum pressure is about 8000 psi.

23. A method as in claim 11, further comprising annealing the nanograined component at a temperature no lower than the eutectic temperature in a manner that inhibits grain growth, and then cooling the nanograined component.

24. A method for forming a body of at least 99.9% density, comprising:

providing a powder composition that exhibits an exothermic behavior in the solid state;

shaping an amount of the powder composition into a body;

applying increasing amounts of heat and pressure to the body to form a microstructure that is at least 99.9% dense; and stopping the application of heat and pressure to the body at a predetermined temperature above the exotherm temperature and below a temperature at which a liquid phase occurs in the composition.

25. A method as in claim 24, wherein the powder composition comprises at least two metals which react exothermally in the solid state.

26. A method as in claim 24, wherein the application of heat and pressure to the body is controlled to form a microstructure wherein at least 25% of the grains have a diameter of not greater than 100 nm.

27. A method as in claim 24, wherein said stopping the application of heat to the body is carried out within one minute of reaching the predetemined temperature.

28. A method as in claim 25, wherein said metals are selected from the group consisting of Ti, Al and Ni.

29. A method for consolidating a nanograined powder comprising:

providing an electrically conductive nanograined powder mass;

applying a high voltage electric current to the powder mass; and applying pressure to the powder mass to consolidate the mass.

* * * * *